US007075248B2

(12) United States Patent
Hsieh et al.

(10) Patent No.: US 7,075,248 B2
(45) Date of Patent: Jul. 11, 2006

(54) LAMP DRIVING SYSTEM

(75) Inventors: Chang-Fa Hsieh, Banchiau (TW); Chih-Kang Lung, Jhongli (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/873,787

(22) Filed: Jun. 22, 2004

(65) Prior Publication Data

US 2004/0257003 A1 Dec. 23, 2004

(30) Foreign Application Priority Data

Jun. 23, 2003 (TW) ..... 92116933 A

(51) Int. Cl.
*H05B 41/16* (2006.01)

(52) U.S. Cl. ..... 315/277; 315/282; 315/312

(58) Field of Classification Search ..... 315/57–58, 315/62, 70, 224–226, 276–277, 282–283, 315/291, 312, 307–308
See application file for complete search history.

(56) References Cited

U.S. PATENT DOCUMENTS

| | | | | |
|---|---|---|---|---|
| 6,534,934 | B1 * | 3/2003 | Lin et al. | 315/312 |
| 6,674,247 | B1 * | 1/2004 | Mead et al. | 315/241 P |
| 6,717,372 | B1 * | 4/2004 | Lin et al. | 315/282 |
| 6,781,325 | B1 * | 8/2004 | Lee | 315/282 |

FOREIGN PATENT DOCUMENTS

| | | |
|---|---|---|
| TW | 478292 | 3/2002 |

* cited by examiner

*Primary Examiner*—Thuy Vinh Tran
(74) *Attorney, Agent, or Firm*—Thomas, Kayden, Horstemeyer & Risley

(57) ABSTRACT

A system driving a lamp set having a first lamp and a second lamp is provided. The system has a power supply circuit providing an AC signal to the lamp set, and a balance circuit having a current balancing transformer, a first impedance and a second impedance for balancing currents through the first and second iamps. The current balancing transformer includes a first winding and a second winding. The first and second windings are wound on the same magnetic core and have the same winding count. A specific relationship between the first and second impedances balances the current values through the first and second lamps effectively without increasing inductances of the current balancing transformer.

18 Claims, 6 Drawing Sheets

LAMP DRIVING SYSTEM

BACKGROUND OF THE INVENTION

1. Field of the Invention

The present invention relates in general to a lamp driving system, and more specifically to a balance circuit for a liquid crystal display (LCD).

2. Description of the Related Art

A power supply circuit supplies an AC current to a cold cathode fluorescent lamp (CCFL) acting as a light source (or a backlight) for a LCD. A feedback and control circuit stabilizes the CCFL current. Large LCD panels usually require two or more fluorescent lamps for sufficient back lights of the LCD.

FIG. 1 illustrates a circuit diagram of a conventional lamp driving system. The lamp driving system comprises a driving circuit 10, a transformer 12, and a feedback and control circuit 20, for driving a first lamp 62 and second lamp 64. The first current I1 and second current I2 of the first lamp 62 and second lamp 64 are not balanced, due to different impedances of the first lamp 62 and second lamp 64. The lamp driving system, shown in FIG. 1, controls the total current of the first lamp 62 and second lamp 64 but can not balance individual currents through the first lamp 62 and second lamp 64. The imbalance not only reduces luminance, but also shortens the lifetime of the lamps.

FIG. 2 illustrates a circuit diagram of another conventional lamp driving system for driving a first lamp 62, a second lamp 64, a third lamp 66, to nth lamp 68. In the lamp driving system, a driving circuit 10 is used to convert a DC signal to an AC signal. In addition, a transformer 12 has a primary winding 12*a* coupled to the driving circuit 10, and a secondary winding 12*b* outputting the AC signal. A balance circuit 30, coupled to these lamps 62~68, balances the currents from the 10 first lamp 62, the second lamp 64, the third lamp 66 . . . to the nth lamp 68. The balance circuit 30 is a multi-winding transformer with every winding distribution coupled to a lamp, and equal number of windings wound on the same magnetic core. The balance circuit 30 can be coupled to the high voltage terminals or low voltage terminals of the lamps. A feedback and control circuit 20 is coupled to the first lamp 62, the second lamp 64, the third lamp 66 . . . to the nth lamp 68 so as to control the driving circuit 10 according to the first current I1, the 20 second current 12, and the third current I3 . . . to the nth current In.

FIG. 3 shows root-mean-square current (Irms) waveforms of the first lamp and second lamp in FIG. 2, FIG. 4 shows sine-wave current waveforms of the first lamp 25 and second lamp in FIG. 2. The balance circuit 30 of FIG. 2 can not sufficiently control the error values of first current 62 and second current 64 to balance lamp currents.

In this lamp driving system, the balance circuit 30 30 is a transformer with multiple windings and each of the windings has the same winding number To effectively control current errors produced by first lamp 62 and second lamp 64, the inductance value of every winding of the transformer (balance circuit 30) must be very high (greater than 1 Henry), so as to achieve current balance. FIG. 5 is a root-mean-square current (Irms) waveform showing a first and second lamp controlled by a current balancing circuit using an inductance of two Henry, and FIG. 6 is a current sine-waveform diagram thereof. As shown in FIGS. 5 and 6, the first current I1, the second current I2, the third current I3, . . . to the nth current In can achieve a better balance by increasing inductance value of the balance circuit 30 (transformer with multiple windings). However, as inductance of transformer is increased, such as greater than one Henry, the volume of the transformer is also increased, and then the manufacturing process becomes complicated and the manufacturing costs is further increased.

SUMMARY OF THE INVENTION

Therefore, an object of the present invention is to provide a lamp driving system with a balance circuit for balancing lamp currents in a liquid crystal display (LCD) backlight.

The present invention achieves the above-indicated object by providing a lamp driving system for a lamp set comprising a first lamp having a first current and a second lamp having a second current. The lamp driving system comprises a power supply circuit supplying the lamp set with AC signal, and a balance circuit coupled to the lamp set so as to balance the first and second currents.

The balance circuit further comprises a current balancing transformer, a first impedance and a second impedance. The current balancing transformer comprises a first winding coupled to the first lamp and a second winding coupled to the second lamp, both wound on the same magnetic core and having the same winging count.

The first impedance is connected in parallel with the first winding and the second impedance is electrically coupled between the first winding and second winding, with a specific relationship between the first and second impedance balancing the current values through the first lamp and the second lamp. The inductances of current balancing transformer remain unchanged.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

FIRST EMBODIMENT

Figure 1:
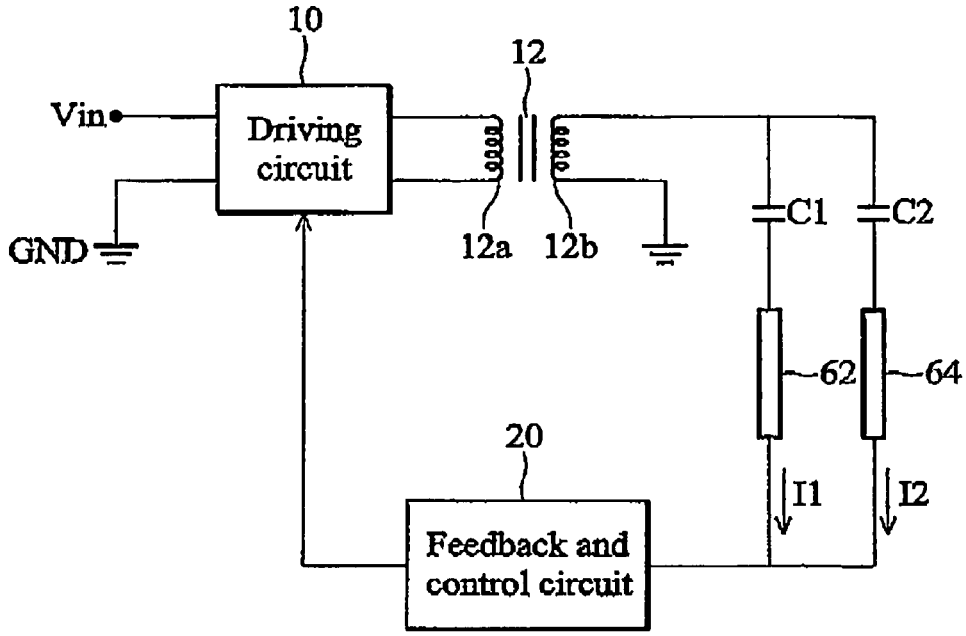
FIG. 1 (RELATED ART)
FIG. 1 is a circuit diagram of a conventional lamp driving system.
Figure 2:
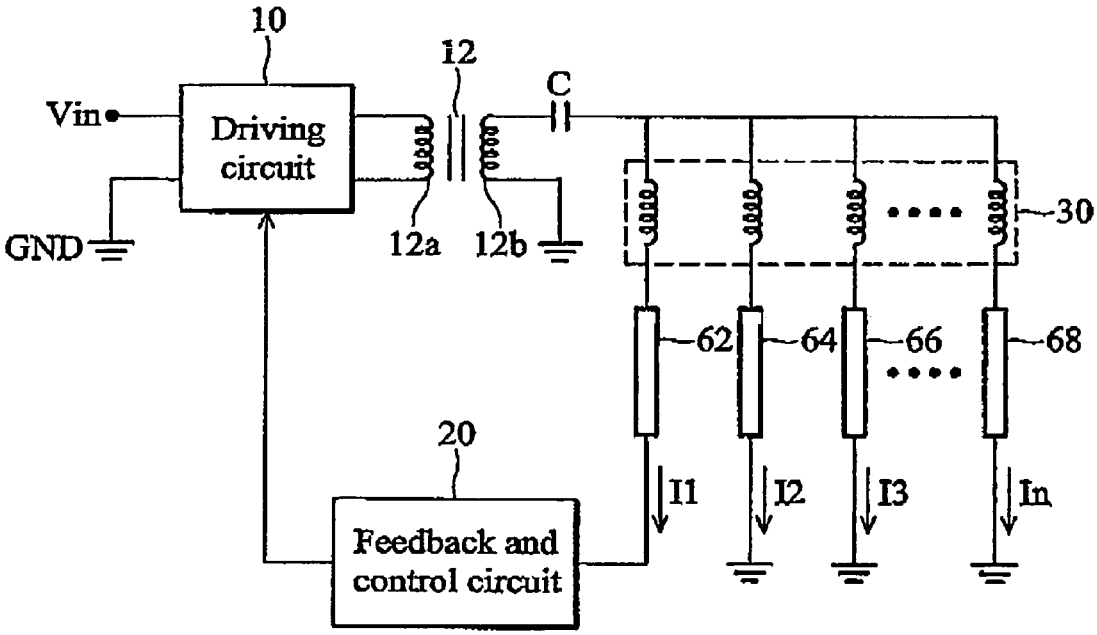
FIG. 2 (RELATED ART)
FIG. 2 is a circuit diagram of another conventional lamp driving system in another scheme from the related art.
Figure 3:
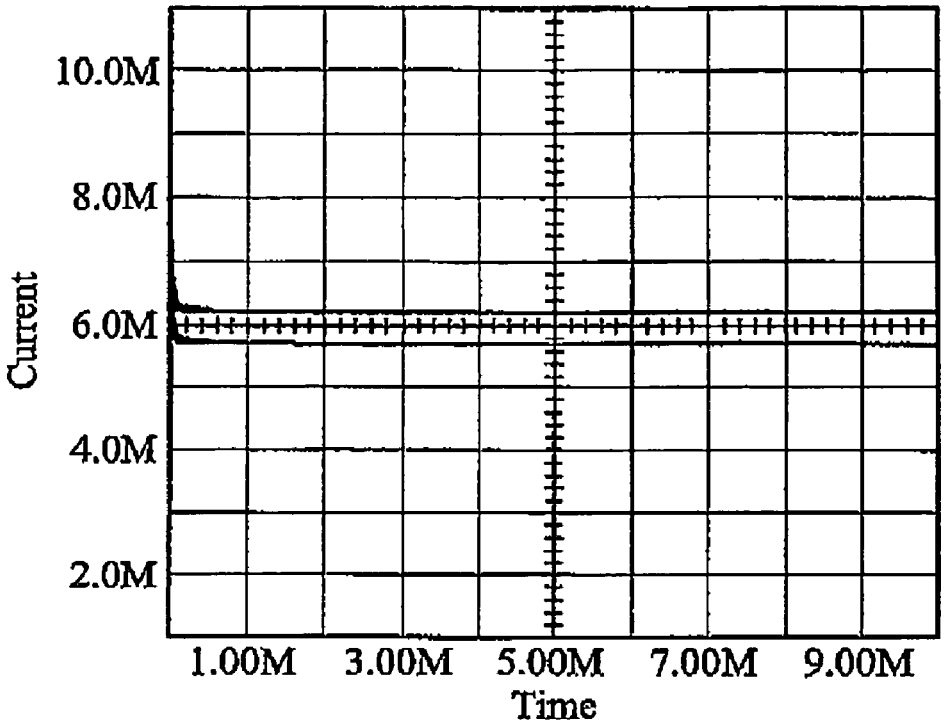
FIG. 3 (RELATED ART)
FIG. 3 shows root-mean-square current (Irms) waveforms of the first and second lamps in FIG. 2.
Figure 4:
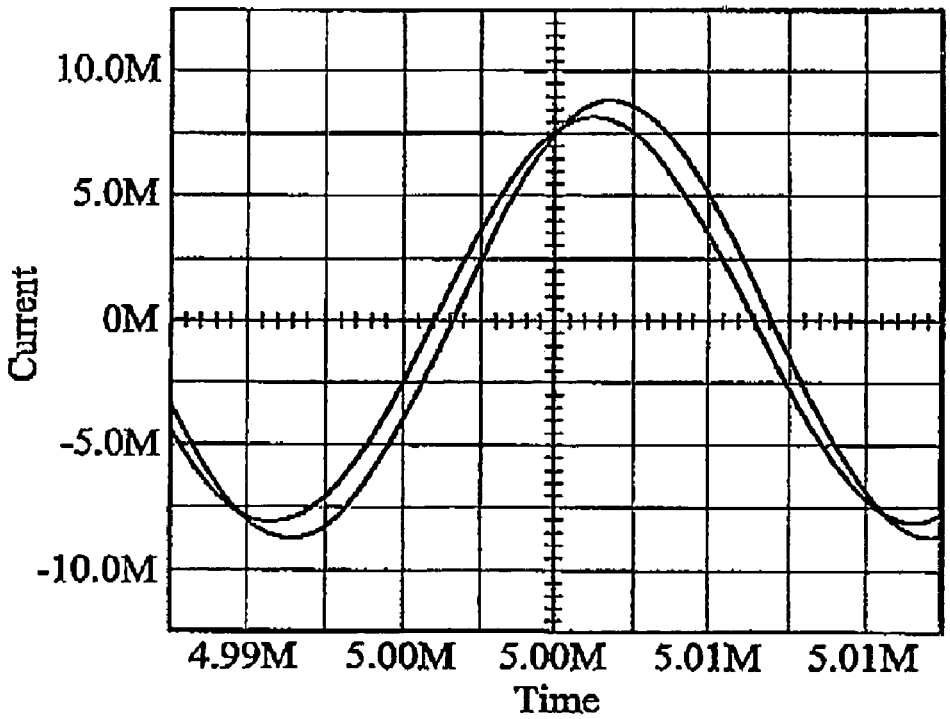
FIG. 4 (RELATED ART)
FIG. 4 shows sine-wave current waveforms of the first and second lamps in FIG. 2.
Figure 5:
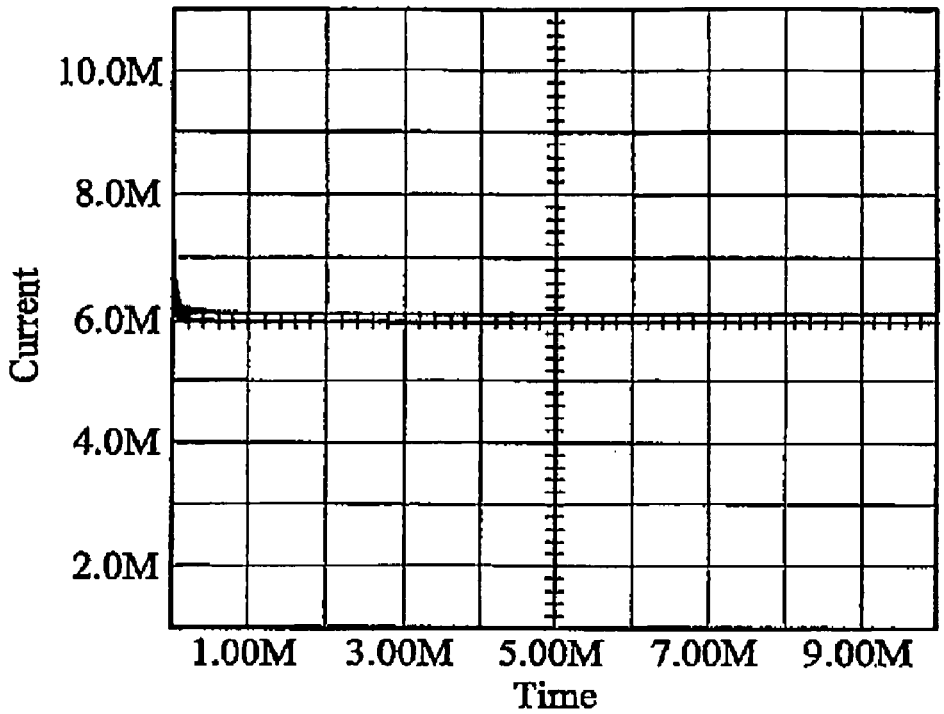
FIG. 5 (RELATED ART)
FIG. 5 shows root-mean-square current (Irms) waveforms of the first and second lamps, when using a current balancing circuit with an inductance of two Henry.
Figure 6:
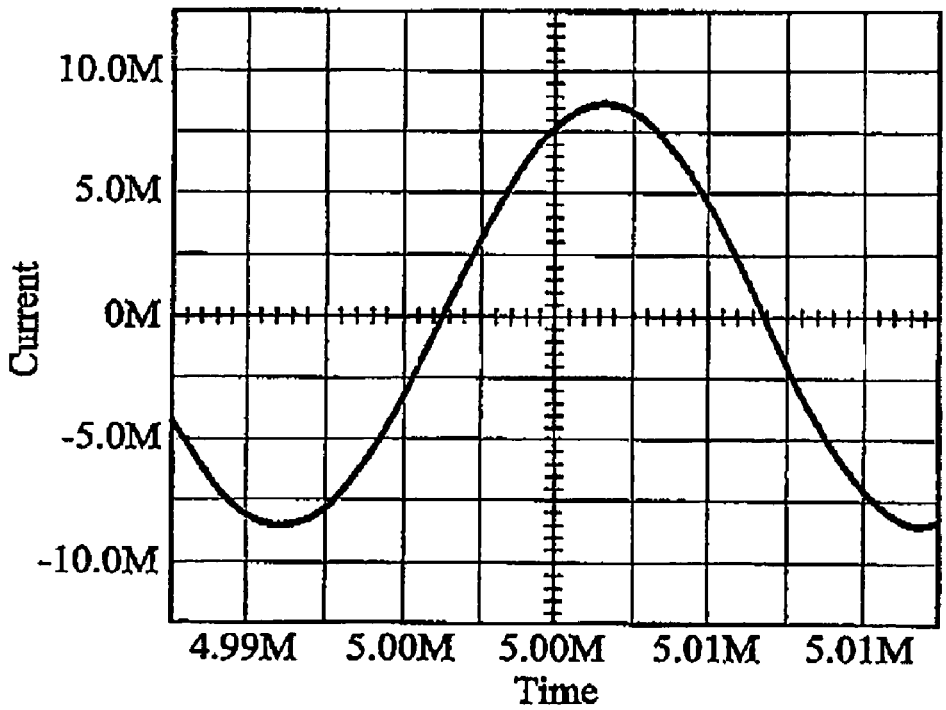
FIG. 6 (RELATED ART)
FIG. 6 shows sine-wave current waveforms of the first and second lamps, when using a current balancing circuit with an inductance of two Henry.
Figure 7:
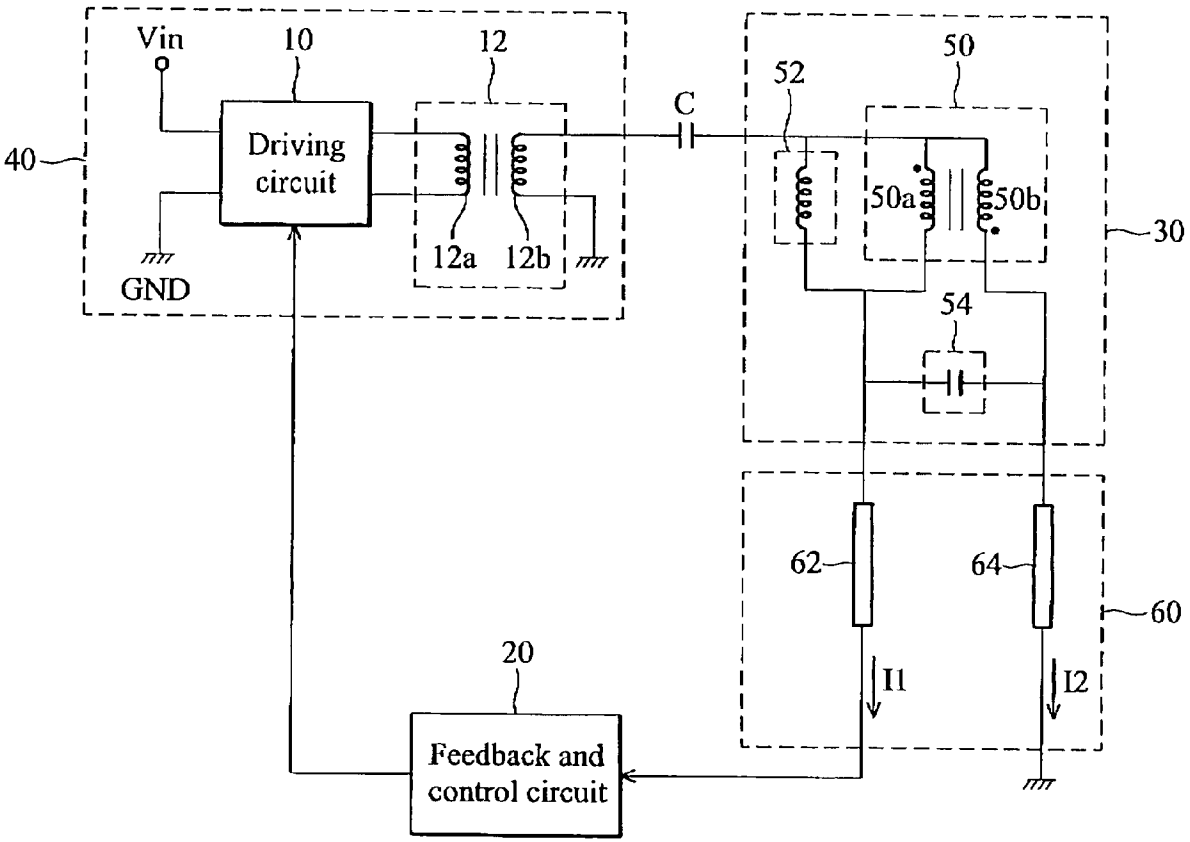
FIG. 7 is a circuit diagram of the multi-lamp driving system in accordance with the first embodiment of the present invention.

FIG. 7 is a circuit diagram of the multi-lamp driving system in accordance with the first embodiment of the present invention. A power supply circuit 40 comprises a driving circuit 10 and a transformer 12 providing an AC signal to the lamp set 60, a balance circuit 30 coupled between the power supply circuit 40 and lamp set 60, and a feedback and control circuit 20 coupled between the lamp set 60 and driving circuit 10.

For lamp driving systems, a power supply circuit 40 comprises a driving circuit 10 converting DC signal Vin to an AC signal, a driving transformer 12 comprises a primary winding coupled to the driving circuit 10, receiving the AC signal, a secondary winding 12*b* for outputting the AC signal to a lamp set 60 having a high voltage terminal and a low voltage terminal, lamp set 60 further comprising a first lamp 62 and a second lamp 64. The balance circuit 30 is coupled between the high voltage terminals of lamp set 60 and the secondary winding 12*b* of driving transformer 12 to balance first current I1 and second current I2. The balance circuit 30 comprises a current balancing transformer 50, a first impedance 52 and a second impedance 54. The current balance transformer 50, with a different dot polarization for controlling the direction of first current I1 and second current I2, comprises a first winding 50*a* coupled to the high voltage terminal of first lamp 62 and a second winding 50*b* coupled to the high voltage terminal of second lamp 64. First winding 50*a* and second winding 50*b* are wound on the same magnetic core and have the same winding count (count ratio 1:1), for balancing first current I1 and second current I2. The impedance 52 performs inductive characteristic (i.e. an inductor) in this embodiment, represented by $X_L$, and the second impedance 54 performs a capacitive characteristic (i.e. a capacitor), represented by $X_C$. Capacitor C corrects the harmonic waves of first lamp 62 and second lamp 64.

First impedance 52 is connected in parallel with the first winding 50*a* of current balancing transformer 50. Second impedance 54 is coupled between the first winding 50*a* and second winding 50*b* of current balancing transformer 50, and is electrically coupled between first lamp 62 and second lamp 64. A specific relationship exists between the first impedance 52 and the second impedance 54, such as the value of second impedance 54 being twice that of first impedance ($X_C$=2$X_L$), providing reduced inductances and winding count in the current balancing transformer 50.

The feedback and control circuit 20 is coupled between the low voltage terminal of first lamp 62 or second lamp 64 and driving circuit 10 according to the first current I1 to control the driving circuit 10 supply of AC signal to the first lamp 62 and second lamp 64.

Figure 9:
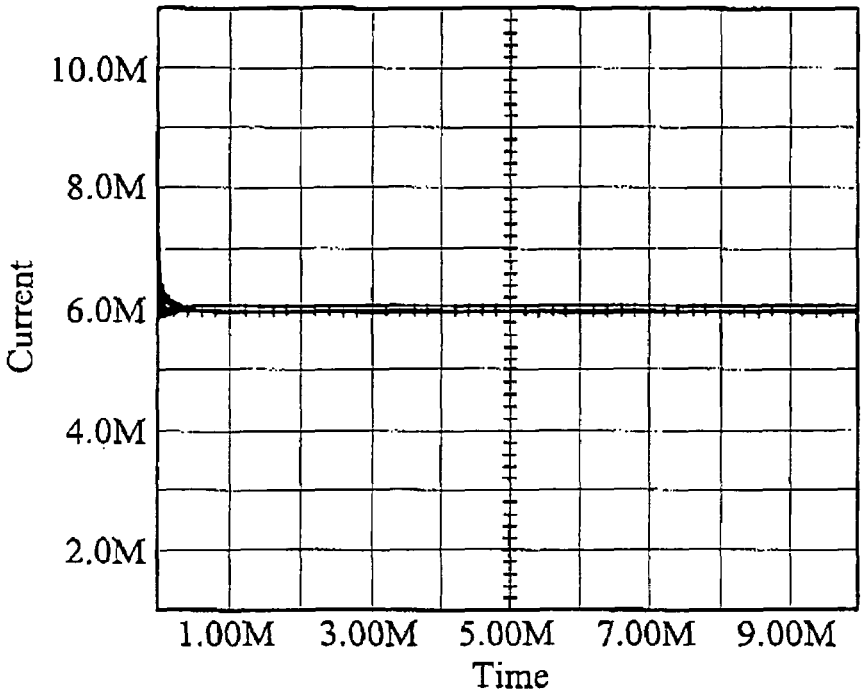
FIG. 9 shows root-mean-square current (Irms) waveforms of the first and second lamps in accordance with the first embodiment of the present invention.
Figure 10:
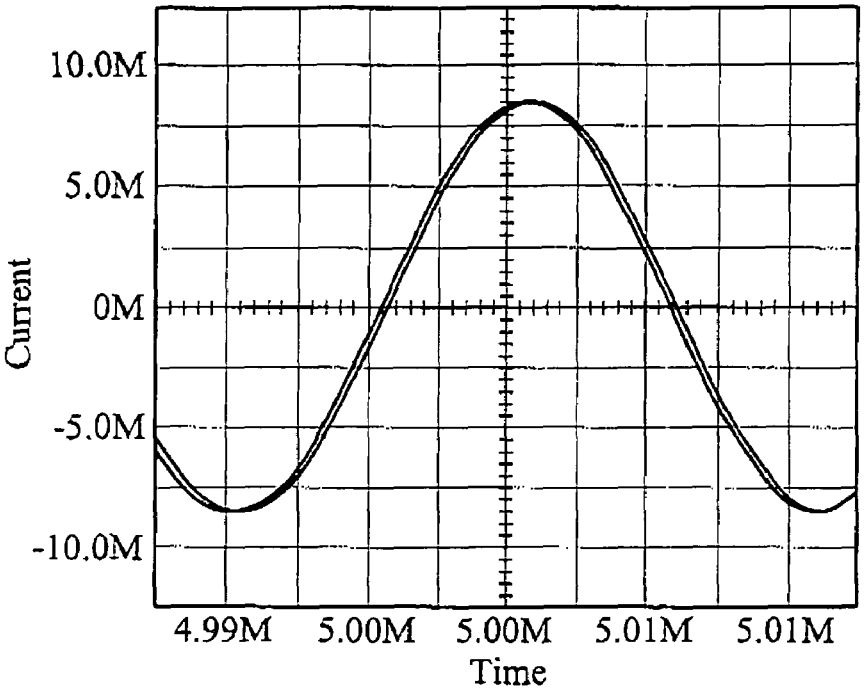
FIG. 10 shows sine-wave current waveforms of the first and second lamps in accordance with the first embodiment of the present invention.

FIG. 9 shows root-mean-square current (Irms) waveforms of the first and second lamps in accordance with the first embodiment of the present invention, and FIG. 10 shows sine-wave current waveforms of the first and second lamps in accordance with the first embodiment of the present invention. Based on the results shown in FIGS. 9 and 10, the first current I1 and the second current I2 are balanced without increasing the inductance of the current balance circuit 50 according to the first embodiment of the invention.

SECOND EMBODIMENT

Figure 8:
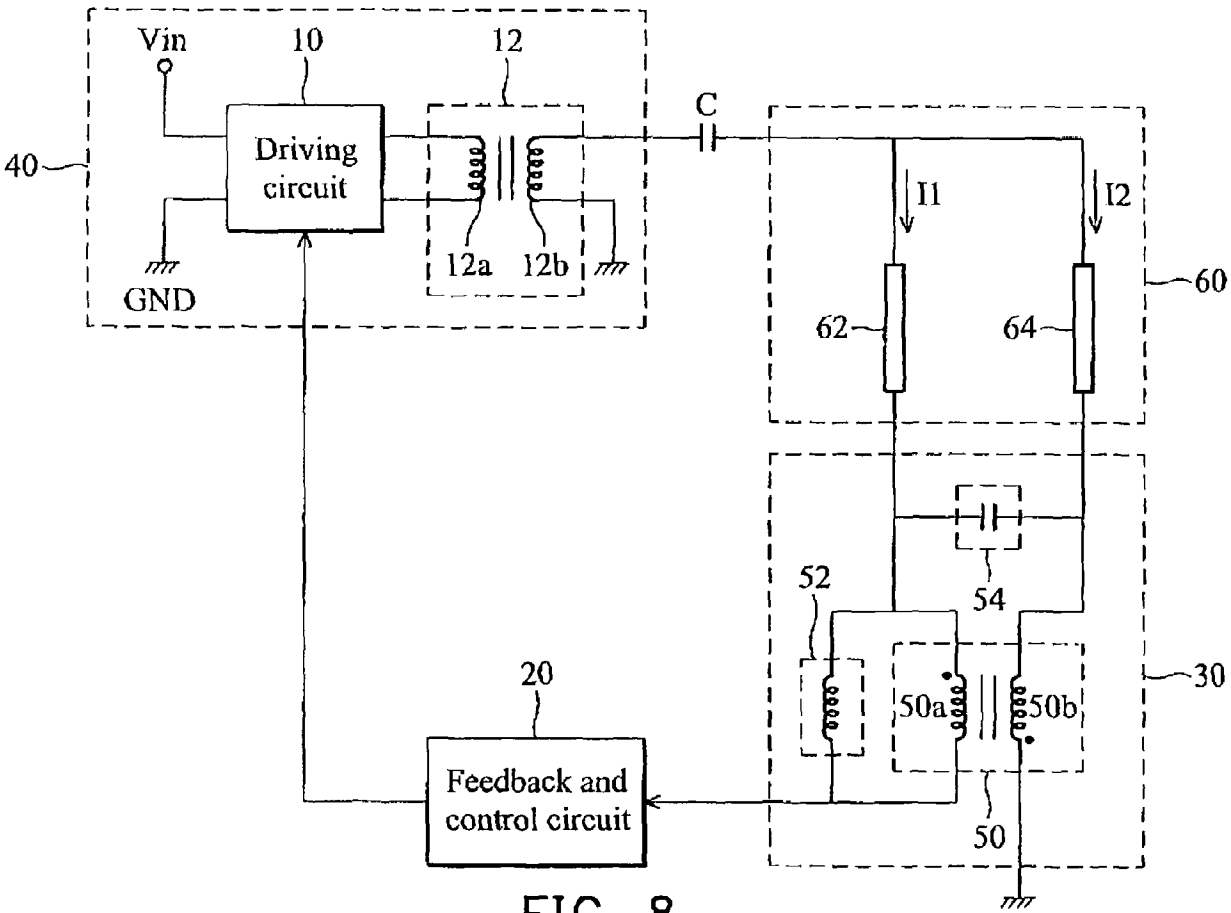
FIG. 8 is a circuit diagram lamp driving system in accordance with the second embodiment of the present invention.

FIG. 8 is a circuit diagram lamp driving system in accordance with the second embodiment of the present invention. Unlike the first embodiment as shown in FIG. 7, however, the secondary winding 12*b* of driving transformer 12 is coupled to the high voltage terminal of first lamp 62 and second lamp 64, and the balance circuit 30 between the low voltage terminal of first lamp 62 and second lamp 64 and the feedback and control circuit 20.

In the invention, a specific relationship between the first and second impedance reduces inductance values and required winding count in the current balancing transformer, reducing assembly costs and complexity; and current control applied to the first and second lamps minimizes errors (current unbalance), and provides stabilized brightness, increasing quality and lifetime of the display.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lamp driving system for a lamp set having a first lamp and a second lamp, comprising:

a power supply circuit supplying the lamp set with AC signal; and a balance circuit coupled to the lamp set, so as to balance a first current of the first lamp and a second current of the second lamp, the balance circuit comprising:

a current balancing transformer comprising a first winding coupled to the first lamp and a second winding coupled to the second lamp, the first and second windings being wound on one magnetic core and having a same winding count;

a first impedance connected in parallel with the first winding; and a second impedance electrically coupled between the first winding and second winding, with a specific relationship between the first and second impedances.

2. The lamp driving system as claimed in claim 1, further comprising a feedback and control circuit coupled between the first lamp or second lamp and the power supply circuit, so as to control the power supply circuit according to a current value of the first lamp or second lamp.

3. The lamp driving system as claimed in claim 1, wherein the value of the second impedance is substantially double that of the first impedance.

4. The lamp driving system as claimed in claim 1, wherein the first impedance is an inductor, and the first impedance has a substantially same impedance value as the first winding of the current balancing transformer.

5. The lamp driving system as claimed in claim 4, wherein the second impedance is a capacitor.

6. The lamp driving system as claimed in claim 1, wherein the first and second windings of the current balancing transformer have opposite dot polarizations.

7. A lamp driving system for a lamp set having the first and second lamps, the lamp set comprising a high voltage terminal and a low voltage terminal, and the lamp driving system comprising:

a driving circuit converting a DC signal to an AC signal;

a driving transformer comprising a primary winding coupled to the driving circuit and a secondary winding outputting the AC signal; and a balance circuit electrically coupled to the high voltage terminal of the lamp set to balance current values of the first and second lamps, the balance circuit comprising:

a current balancing transformer comprising a first winding coupled to the first lamp and a second winding coupled to the second lamp, the first and second windings being wound on a magnetic core and having a same winding count;

a first impedance connected in parallel with the first winding; and a second impedance electrically coupled between the first winding and second winding, with a specific relationship between the first and second impedances.

8. The lamp driving system as claimed in claim 7, further comprising a feedback and control circuit coupled between the first lamp or second lamp and the driving circuit so as to control the driving circuit according to the current value of the first lamp or second lamp.

9. The lamp driving system as claimed in claim 7, wherein the value of the second impedance is substantially double that of the first impedance.

10. The lamp driving system as claimed in claim 7, wherein the first impedance is an inductor and the first impedance has a substantially same impedance value as the first winding of the current balancing transformer.

11. The lamp driving system as claimed in claim 10, wherein the second impedance is a capacitor.

12. The lamp driving system as claimed in claim 7, wherein the first and second windings have opposite dot polarizations.

13. A lamp driving system for a lamp set having a first lamp and a second lamp, the lamp set comprising a high voltage terminal and a low voltage terminal, and the lamp driving system comprising:

a driving circuit converting a DC signal to an AC signal;

a driving transformer comprising a primary winding coupled to the driving circuit and a secondary winding outputting the AC signal; and a balance circuit electrically coupled to the high voltage terminal of the lamp set so as to balance current values of the first and second lamps, the balance circuit comprising:

a current balancing transformer comprising a first winding coupled to the first lamp and a second winding coupled to the second lamp, and the first and second windings being wound on a magnetic core and having a same winding count;

a first impedance connected in parallel with the first winding; and a second impedance electrically coupled between the first winding and second winding, with a specific relationship between the first and second impedances.

14. The lamp driving system as claimed in claim 13, further comprising a feedback and control circuit coupled between the first lamp or second lamp and the driving circuit to control the driving circuit according to the current value of the first lamp or second lamp.

15. The lamp driving system as claimed in claim 13, wherein the value of the second impedance is substantially double that of the first impedance.

16. The lamp driving system as claimed in claim 13, wherein the first impedance provides inductive impedance, and the first impedance has a substantially same impedance value as the first winding of the current balancing transformer.

17. The lamp driving system as claimed in claim 16, wherein the second impedance is a capacitor.

18. The lamp driving system as claimed in claim 13, wherein the first and second windings of the current balancing transformer have opposite dot polarizations.

* * * * *